US009776248B2

(12) United States Patent
Li et al.

(10) Patent No.: US 9,776,248 B2
(45) Date of Patent: Oct. 3, 2017

(54) METHOD FOR SYNTHESIZING NANOWIRES AND NANOFOAM

(71) Applicant: United Technologies Corporation, Hartford, CT (US)

(72) Inventors: Weina Li, South Glastonbury, CT (US); Michael J. Birnkrant, Kenilworth, NJ (US); James T. Beals, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 329 days.

(21) Appl. No.: 14/604,309

(22) Filed: Jan. 23, 2015

(65) Prior Publication Data

US 2015/0209864 A1 Jul. 30, 2015

Related U.S. Application Data

(60) Provisional application No. 61/931,279, filed on Jan. 24, 2014.

(51) Int. Cl.

| | |
|---|---|
| ***B22F 9/24*** | (2006.01) |
| ***B22F 1/00*** | (2006.01) |
| ***B22F 3/00*** | (2006.01) |
| ***C22C 1/04*** | (2006.01) |

(52) U.S. Cl.

CPC ..... *B22F 9/24* (2013.01); *B22F 1/0025* (2013.01); *B22F 3/002* (2013.01); *C22C 1/0433* (2013.01)

(58) Field of Classification Search

None

See application file for complete search history.

(56) References Cited

U.S. PATENT DOCUMENTS

| | | | | |
|---|---|---|---|---|
| 2007/0278457 | A1* | 12/2007 | Nakamoto | B22F 1/0062 252/519.2 |
| 2012/0148844 | A1* | 6/2012 | Whitcomb | B22F 1/0025 428/401 |
| 2012/0219703 | A1* | 8/2012 | Son | B22F 3/22 427/123 |
| 2017/0047150 | A1* | 2/2017 | Takeda | C08L 101/00 |

OTHER PUBLICATIONS

Al-Thabaiti, S.A. et al., "Au(III)-Surfactant Complex-Assisted Anisotropic Growth of Advanced Platonic Au-Nanoparticles", Canadian Chemical Transactions, vol. 1, Issue 4, pp. 238-252, Oct. 8, 2013.*

General Chemistry/Introduction to Kinetics, from Wikibooks, last updated Oct. 31, 2013.*

* cited by examiner

*Primary Examiner* — George Wyszomierski

(74) *Attorney, Agent, or Firm* — Kinney & Lange, P.A.

(57) ABSTRACT

A method for making a plurality of metallic nanowires includes combining a metallic precursor with a solvent to form a metallic precursor solution. A quantity of oxalic acid is added to the metallic precursor solution to form a reduction solution. A plurality of nanowires are precipitated out from the reduction solution.

26 Claims, 2 Drawing Sheets

METHOD FOR SYNTHESIZING NANOWIRES AND NANOFOAM

BACKGROUND

The described subject matter relates generally to nanomaterials, and more specifically to metallic nanowires and nanofoams.

Lightweight materials are generally needed for numerous applications, including military and commercial aerospace products. Current advanced materials in broad use include superalloys, ceramic matrix composites, and intermetallics, among others. One promising class of materials includes nanomaterials such as metallic nanocellular foam (NCF) which is composed of nano-size building blocks such as nanowires. Very recently, a wet chemistry method was developed to fabricate metallic nanowires via a reduction agent of hydrazine. Though effective at reducing metals such as nickel from solution, the use of hydrazine to form in situ nanowires requires careful handling and disposal of the raw materials and process outputs particularly for scaled up systems.

SUMMARY

In one embodiment, a method for making a plurality of metallic nanowires includes combining a first metallic precursor with a first solvent to form a first metallic precursor solution. A first quantity of oxalic acid is added to the first metallic precursor solution to form a first reduction solution. A first plurality of nanowires are precipitated out from the first reduction solution.

In another embodiment, a method for making a nanocellular foam includes combining a first metallic precursor with a solvent to form a metallic precursor solution. A quantity of oxalic acid is added to the metallic precursor solution to form a reduction solution, thereby causing a first plurality of metallic nanowires to precipitate out from the reduction solution. The first plurality of precipitated nanowires is arranged into a porous nanostructure.

DETAILED DESCRIPTION

Nanostructures such as nanocellular foams are a promising alternative for a number of industrial applications. They can be made either from a combination of metallic nanowires, each of which may contain a single substantially pure metal. Additionally or alternatively alloyed nanowires can be introduced into the structure to modify various properties.

Figure 1:
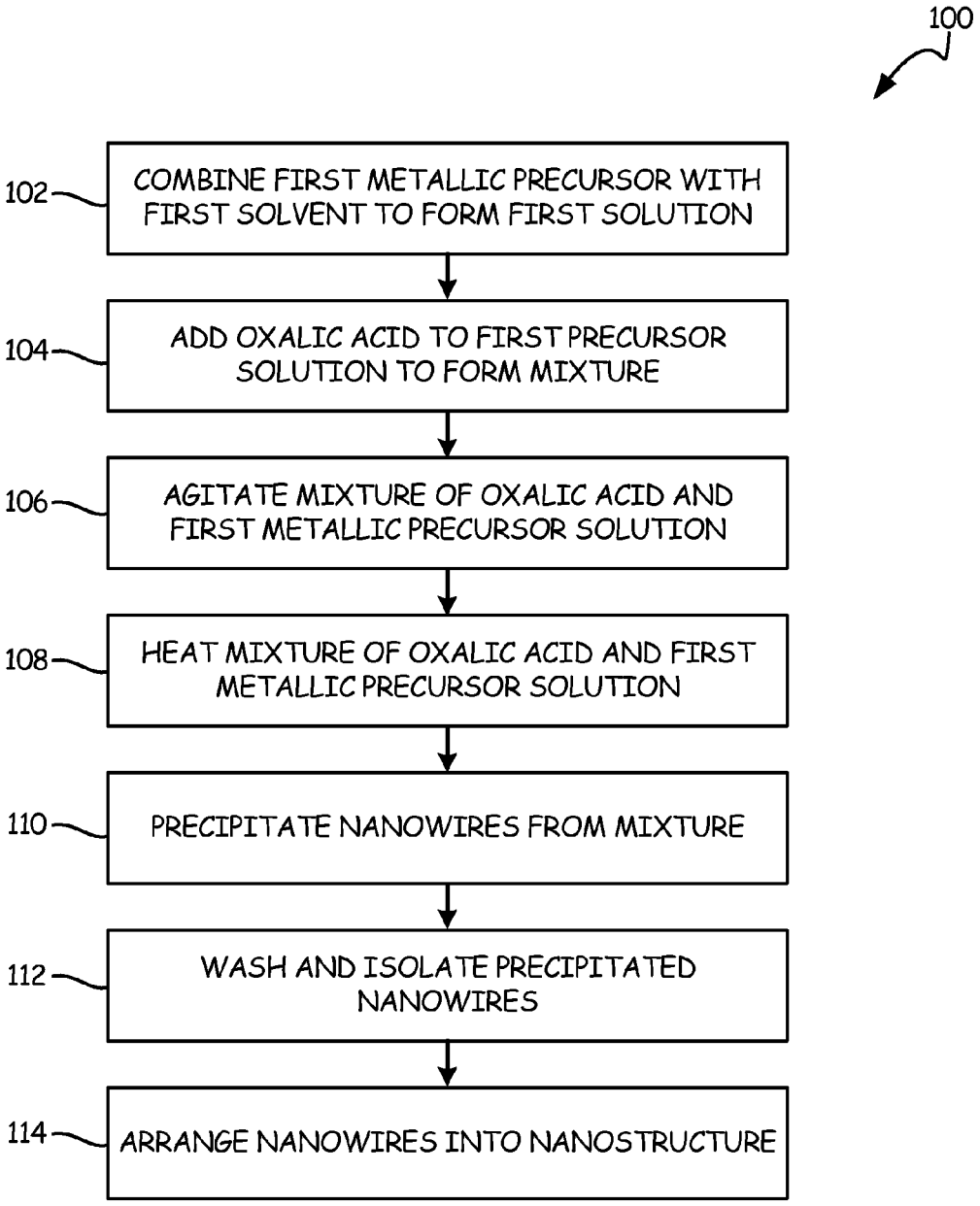
FIG. 1 shows a first process for making a nanomaterial from a plurality of metallic nanowires.

FIG. 1 generally shows steps for example method 100. Method 100 for making a plurality of metallic nanowires includes step 102 in which a metallic precursor can be combined with a solvent to form a metallic precursor solution. Typically, the metallic precursor is an ionic compound (e.g., a metallic salt) containing an ionic species of the metal to be used to form the nanowires, and which is soluble in the selected solvent(s). In one example, to form nickel nanowires, a nickel salt such as nickel chloride is dissolved in water to form an aqueous metallic precursor solution. The solvent can additionally and/or alternatively include another compatible composition such as ethylene glycol ($(CH_2OH)_2$).

Step 104 includes adding a quantity of oxalic acid solution to the metallic precursor solution to form a reduction solution. During and after step 104, a plurality of nanowires can be precipitated out from the reduction solution. Here, the oxalic acid operates as a reduction agent in which the ionic species in the metallic precursor solution is converted into a metal.

To facilitate precipitation step 110 (described below), the mixture of oxalic acid and the precursor solution can be agitated (step 106), and/or heated (step 108). Agitation of the mixture ensures good contact between the ionic species and the reduction agent (oxalic acid), while heating the mixture of oxalic acid and the precursor solution can ensure sufficient dissociation and free energy in the system. Both steps 106 and 108 help to move the reactions in the desired direction.

As part of step 110, the metal is precipitated out from the reduction solution. Oxalic acid ($H_2C_2O_4$) can be an effective agent for reducing ionic species of metals (such as nickel) from aqueous solutions. With respect to nickel, the decomposition reaction of oxalic acid in an aqueous solution has a net electronegative potential ($E^0$) greater than in the reduction reaction of nickel cations to elemental nickel. This is shown in equations 1 and 2 below.

$$Ni^{2+}+2e^{-}\text{<->}Ni(E^0=-0.25V) \quad (1)$$

$$2CO_2+2e^{-}+2H^{+}\text{<->}H_2C_2O_4(E^0=-0.49V) \quad (2)$$

In this and in similar metallic reduction reactions, decomposition of the oxalic acid into CO2, H+ and e− has a net $E^0$ value smaller than the reduction of the metal. As a result, other metals such as Fe, Mo, Co, Cu, and W can also be reduced to form nanowires (from aqueous solutions of corresponding metal salts) in a similar manner.

Two existing methods for producing nanowires and other nanostructures include reduction using hydrazine, and reduction in a high temperature, otherwise inert environment. High temperatures require substantial energy inputs, and the solution can be less stable than the above reactions using oxalic acid. And in the case of hydrazine, byproducts of the decomposition reaction can include ammonia and hydrogen gas, therefore necessitating special handling and disposal procedures on both sides of the process, which increases the costs and complexity of producing metal nanostructures.

The resulting metallic species precipitate into bulk metallic nanowires. In certain embodiments, the nanowires can be arranged into an extremely lightweight and thermally resistant nanomaterial for aerospace or other use. In addition to aerospace applications, nanocellular foams (NCF) and other nanostructures made according to the described processes can also be used in catalytic, electrochemical (e.g., battery), and biologic applications. Nanowires according to this process can also be incorporated to provide electrical and thermal conductivity into polymer matrix composites.

To achieve the desired nanostructure(s), optional step 112 includes a washing step for the precipitated nanowires. In one example embodiment, the washing step can include a filtration portion and a centrifuging portion. For making nickel and nickel alloy nanostructures, the nanowires are filtered out of the remaining reduction solution, while simultaneously or subsequently being centrifuged in a speed range which removes excess liquid while preventing damage to the long metal nanowires precipitated from solution. The long nanowires add flexibility to numerous nanostructures while decreasing brittleness relative to the use of other building blocks for nanostructures.

Following the production of nanowires according to some or all of preceding steps 102-112, the plurality of precipitated nanowires can be combined into a porous nanostructure as part of step 114. The nanowires can first be manipulated so that they are partially isolated from one another and can later be assembled into a desired bulk shape.

The choice of metals available for use in producing nanowires is dictated at least in part by the electronegativity of the metal reduction reaction relative to decomposition of oxalic acid. While various metals can be used for the nanowires, the plurality of metallic nanowires can include substantially pure nickel. In examples used to produce at least some nickel nanowires for later combination into other porous nanostructures, the metallic precursor solution can include at least in part a nickel salt.

In addition to nickel, certain other metal nanowires can be precipitated from an aqueous solution. Suitable candidates include those having a net electronegative reduction potential less than the reduction potential of the decomposition reaction of oxalic acid referenced in Equation 2. The most likely of such candidates to form metallic nanowires out of the oxalic acid solution can additionally and/or alternatively include a metal selected from Fe, Co, Cu, W, and Mo. Precipitation of these nanowires would therefore require a corresponding salt which has highly dissociative properties in water or other aqueous solution(s). Non-limiting examples therefore include but are not limited to ionic compounds containing, Fe, Co, Cu, W, and Mo (e.g., $FeCl_2$, $CoCl_2$, $CuCl_2$, $WCl_4$, $MoCl_3$)

Thus steps 102-112 can be repeated for one or more alternative compositions. In certain of these embodiments, a second metallic precursor can be combined with a second solvent to form a second metallic precursor solution according to an iteration of step 102. A second iteration of step 104 includes adding a second quantity of oxalic acid to the second metallic precursor solution to form a second reduction solution containing a mixture of the second metallic precursor solution and the second reduction solution. After optional agitation and heating, another iteration of step 110 can include precipitating a second plurality of nanowires out from the second reduction solution. After one or more iterations of cleaning step 112, the various sets of nanowires from multiple iterations can then be arranged or combined into a nanostructure as part of step 114.

In certain embodiments, some or all of the nickel-based nanowires can also be processed into a nanocellular foam via sintering and consolidation. One process of forming the foam requires a heat treatment, which can include an oxidizing, inert, or reducing environment, depending on the composition of nanowires, and the composition of any oxides or other byproducts remaining from the forming of nanowires. One non-limiting example of a heat treatment for forming nanocellular foams from nanowires, can include heat treating the nanowires for about 8 hours at a temperature of about 600° C. (about 1110° F.) in an reducing environment. The reducing environment can include a forming gas selected to remove any residual or unused solvent, reduce or produce surface oxides, and/or to aid in the actual sintering of the metal nanowires to form a 3-D framework of nanocellular foam(s).

Figure 2:
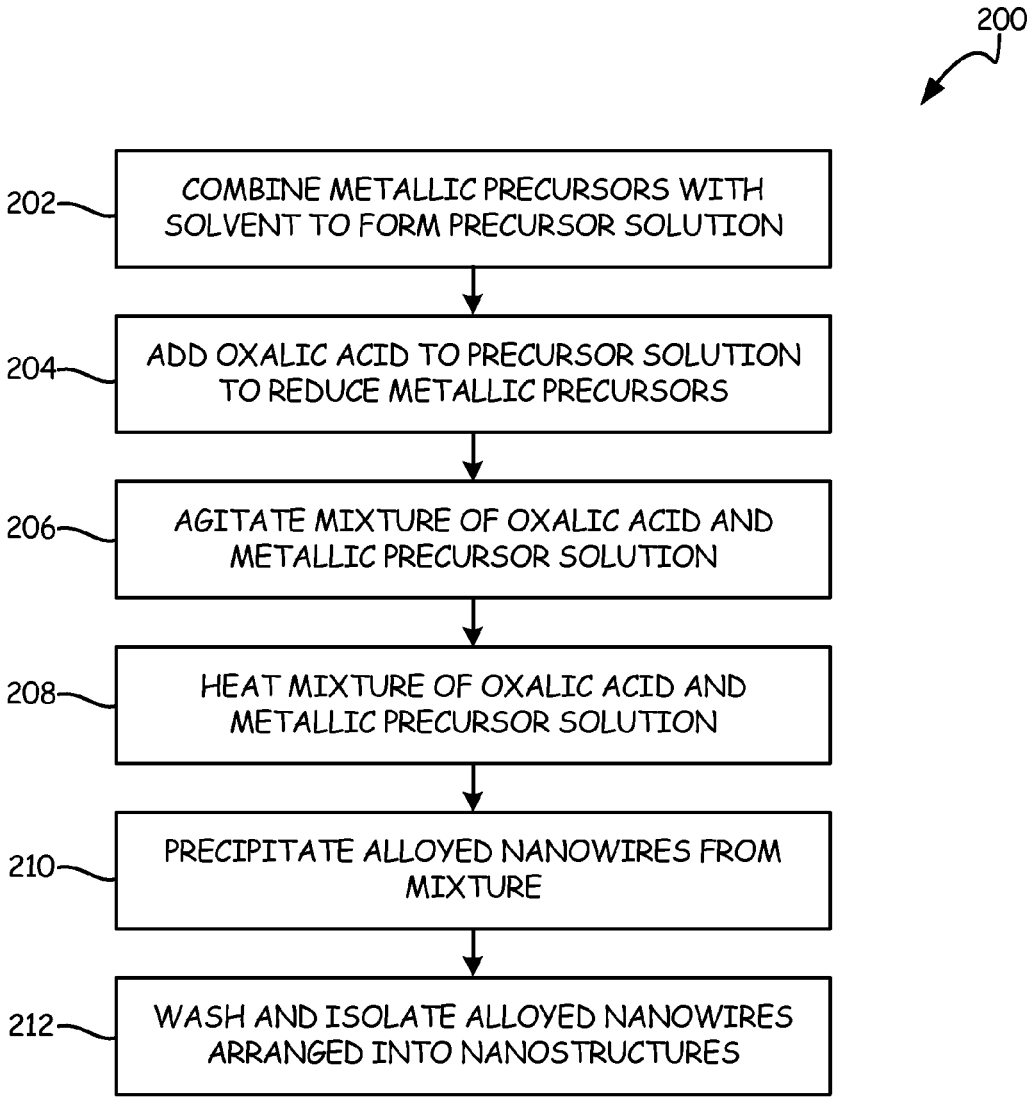
FIG. 2 shows a second process for making a nanomaterial from a plurality of alloyed nanowires.

Method 200, shown in FIG. 2, includes steps for making an alloyed nanocellular foam from an aqueous solution. At step 202, similar to step 102, a first metallic precursor can be combined with a solvent to form a metallic precursor solution. Following this, step 204 can include adding a quantity of oxalic acid to the metallic precursor solution to form a reduction solution, thereby causing a first plurality of metallic nanowires to precipitate out from the (reduction) solution. As in the first method 100 shown in FIG. 1, the oxalic acid can be provided in either hydrate or anhydrous form.

Along with optional agitation (step 206) and heating (step 208), step 210 includes precipitating a plurality of nanowires from the mixture. The nanowires can be formed from nickel alloyed with one or more of Cr, V, W, and Mo as described below. Here, the precipitated nanowires can also be arranged directly into a porous nanostructure based on speed and style of agitation. Further arrangement of the porous nano structure can be performed as part of washing the precipitated nanowires in step 212, in which they are filtered and/or centrifuged.

Like the nanowires formed according to method 100 (FIG. 1), the plurality of alloyed nanowires formed as part of the nanostructure can include primarily nickel. The metallic precursor solution thus can include a nickel salt dissolved in water or aqueous solution with or without ethylene glycol. The nickel salt with a nickel species can be selected from: nickel chloride, nickel nitrate, nickel acetate, and combinations thereof. Optionally, a second metallic precursor can be combined with at least one of the first metallic precursor and the solvent as part of the metallic precursor solution. The second metallic precursor can be a salt selected from: FeCl2, $CoCl_2$, CuCl2, $WCl_4$, $MoCl_3$, or the like which may also be dissolved in water or aqueous solution with or without ethylene glycol. The reduction reaction can then result in alloyed nanowires, which are presently or later formed into a porous nanostructure (e.g., a nanocellular foam) by sintering or other process, such as is described in the example accompanying the description of FIG. 1.

In certain embodiments of making an alloy nanocellular foam, one or metal additional metal salts can be added into either the metallic precursor solution (prior to precipitation of nanowires) Additionally and/or alternatively, the additional metal salt(s) can be added after precipitation of nickel nanowires, after which reducing agents can be added into the solution to process a subsequent reduction reaction. After repeating the washing and filtration as needed, alloying nanowires can be sintered and consolidated to allow for metal diffusion, thereby creating an alloyed nanocellular foam. It will also be appreciated that the strength of the resulting nanocellular foam can be modified by the degree in which nanowire "ligaments" are sintered in thermal cycle(s) after filtering.

Discussion of Possible Embodiments

The following are non-exclusive descriptions of possible embodiments of the present invention.

A method for making a plurality of metallic nanowires includes combining a first metallic precursor with a first solvent to form a first metallic precursor solution. A first quantity of oxalic acid is added to the first metallic precursor solution to form a first reduction solution. A first plurality of nanowires are precipitated out from the first reduction solution.

The method of the preceding paragraph can optionally include, additionally and/or alternatively, any one or more of the following features, configurations and/or additional components:

A method for making a plurality of metallic nanowires according to an exemplary embodiment of this disclosure, among other possible things includes combining a first metallic precursor with a first solvent to form a metallic precursor solution; adding a first quantity of oxalic acid to the first metallic precursor solution to form a first reduction solution containing a mixture of the first metallic precursor solution and the first quantity of oxalic acid; and precipitating a first plurality of nanowires out from the first reduction solution.

A further embodiment of the foregoing method, further comprising: agitating the mixture of oxalic acid and the first metallic precursor solution.

A further embodiment of any of the foregoing methods, further comprising: heating the mixture of oxalic acid and the first metallic precursor solution.

A further embodiment of any of the foregoing methods, further comprising: washing the first plurality of precipitated nanowires.

A further embodiment of any of the foregoing methods, wherein the washing step includes a filtration portion and a centrifuging portion.

A further embodiment of any of the foregoing methods, further comprising: combining the first plurality of precipitated nanowires into a porous nanostructure.

A further embodiment of any of the foregoing methods, wherein the metallic nanowires comprise substantially pure nickel.

A further embodiment of any of the foregoing methods, wherein the metallic precursor solution is an aqueous solution comprising a first salt providing a nickel species.

A further embodiment of any of the foregoing methods, wherein the solvent comprises ethylene glycol ($CH_2OH)_2$).

A further embodiment of any of the foregoing methods, further comprising: combining a second metallic precursor with a second solvent to form a second metallic precursor solution; adding a second quantity of oxalic acid to the second metallic precursor solution to form a second reduction solution containing a mixture of the second metallic precursor solution and the second reduction solution; and precipitating a second plurality of nanowires out from the second reduction solution.

A further embodiment of any of the foregoing methods, wherein the second plurality of nanowires comprises one or more of: Fe, Co, Cu, W, and Mo.

A method for making a nanocellular foam includes combining a first metallic precursor with a solvent to form a metallic precursor solution. A quantity of oxalic acid is added to the metallic precursor solution to form a reduction solution, thereby causing a first plurality of metallic nanowires to precipitate out from the reduction solution. The first plurality of precipitated nanowires is arranged into a porous nanostructure.

The method of the preceding paragraph can optionally include, additionally and/or alternatively, any one or more of the following features, configurations and/or additional components:

A method for making a plurality of metallic nanowires according to an exemplary embodiment of this disclosure, among other possible things includes combining a first metallic precursor with a solvent to form a metallic precursor solution; adding a quantity of oxalic acid solution to the metallic precursor solution to form a reduction solution, thereby causing a plurality of metallic nanowires to precipitate out from the reduction solution; and arranging the plurality of precipitated nanowires into a porous nanocellular foam.

A further embodiment of the foregoing method, further comprising: agitating the mixture of oxalic acid and the precursor solution.

A further embodiment of any of the foregoing methods, further comprising: heating the mixture of oxalic acid and the precursor solution.

A further embodiment of any of the foregoing methods, further comprising: washing the precipitated nanowires.

A further embodiment of any of the foregoing methods, wherein the washing step includes a filtration portion and a centrifuging portion.

A further embodiment of any of the foregoing methods, wherein the plurality of metallic nanowires comprise nickel.

A further embodiment of any of the foregoing methods, wherein the metallic precursor solution comprises a first metallic salt including a nickel species dissolved in water and ethylene glycol.

A further embodiment of any of the foregoing methods, further comprising: combining a second metallic precursor with at least one of the first metallic precursor and the solvent to form the metallic precursor solution.

A further embodiment of any of the foregoing methods, wherein the second metallic precursor comprises a second metallic salt dissolved in the mixture of water and ethylene glycol.

A further embodiment of any of the foregoing methods, wherein the metallic nanowires further comprise a metal selected from Fe, Co, Cu, W, and Mo.

Although the present invention has been described with reference to preferred embodiments, workers skilled in the art will recognize that changes may be made in form and detail without departing from the spirit and scope of the invention.

The invention claimed is:

1. A method for making a plurality of metallic nanowires, the method comprising:

combining a first metallic precursor with a first solvent to form a metallic precursor solution;

adding a first quantity of oxalic acid to the first metallic precursor solution to form a first reduction solution containing a mixture of the first metallic precursor solution and the first quantity of oxalic acid; and precipitating a first plurality of nanowires out from the first reduction solution;

wherein the first plurality of nanowires comprise substantially pure nickel.

2. The method of claim 1 and further comprising:

agitating the mixture of oxalic acid and the first metallic precursor solution.

3. The method of claim 1 and further comprising:

heating the mixture of oxalic acid and the first metallic precursor solution.

4. The method of claim 1 and further comprising:

washing the first plurality of precipitated nanowires.

5. The method of claim 4, wherein the washing step includes a filtration portion and a centrifuging portion.

6. The method of claim 1 and further comprising:

combining the first plurality of precipitated nanowires into a porous nanostructure.

7. The method of claim 1 wherein the first metallic precursor solution is an aqueous solution comprising a first salt providing a nickel species.

8. The method of claim 1, wherein the solvent comprises ethylene glycol ($CH_2(OH)_2$).

9. The method of claim 1, further comprising:

combining a second metallic precursor with a second solvent to form a second metallic precursor solution;

adding a second quantity of oxalic acid to the second metallic precursor solution to form a second reduction solution; and precipitating a second plurality of nanowires out from the second reduction solution.

10. The method of claim 9, wherein the second plurality of nanowires comprises one or more of: Fe, Co, Cu, W, and Mo.

11. A method for making a nanocellular foam, the method comprising:

combining a first metallic precursor with a solvent to form a metallic precursor solution;

adding a quantity of oxalic acid solution to the metallic precursor solution to form a reduction solution, thereby causing a plurality of metallic nanowires to precipitate out from the reduction solution; and arranging the plurality of precipitated nanowires into a porous nanocellular foam.

12. The method of claim 11, and further comprising:

agitating the mixture of oxalic acid and the precursor solution.

13. The method of claim 11, and further comprising:

heating the mixture of oxalic acid and the precursor solution.

14. The method of claim 11, and further comprising:

washing the precipitated nanowires.

15. The method of claim 14, wherein the washing step includes a filtration portion and a centrifuging portion.

16. The method of claim 11, wherein the plurality of metallic nanowires comprise nickel.

17. The method of claim 16, wherein the metallic precursor solution comprises a first metallic salt including a nickel species dissolved in water and ethylene glycol.

18. The method of claim 16, and further comprising:

combining a second metallic precursor with at least one of the first metallic precursor and the solvent to form the metallic precursor solution.

19. The method of claim 18, wherein the second metallic precursor comprises a second metallic salt dissolved in the mixture of water and ethylene glycol.

20. The method of claim 19, wherein the metallic nanowires further comprise a metal selected from Cr, V, W, and Mo.

21. A method for making a plurality of metallic nanowires, the method comprising:

combining a first metallic precursor with a first solvent to form a metallic precursor solution;

adding a first quantity of oxalic acid to the first metallic precursor solution to form a first reduction solution containing a mixture of the first metallic precursor solution and the first quantity of oxalic acid; and precipitating a first plurality of nanowires out from the first reduction solution;

wherein the solvent comprises ethylene glycol ($CH_2(OH)_2$).

22. The method of claim 21 and further comprising:

agitating and heating the mixture of oxalic acid and the first metallic precursor solution.

23. The method of claim 21 and further comprising:

washing the first plurality of nanowires;

wherein the washing step includes a filtration portion and a centrifuging portion.

24. The method of claim 21 and further comprising:

combining the first plurality of precipitated nanowires into a porous nanostructure.

25. The method of claim 21, wherein:

the first plurality of metallic nanowires comprise substantially pure nickel; and the first metallic precursor solution is an aqueous solution comprising a first salt providing a nickel species.

26. The method of claim 21, further comprising:

combining a second metallic precursor with a second solvent to form a second metallic precursor solution;

adding a second quantity of oxalic acid to the second metallic precursor solution to form a second reduction solution; and precipitating a second plurality of nanowires out from the second reduction solution;

wherein the second plurality of nanowires comprises one or more of: Fe, Co, Cu, W, and Mo.

* * * * *